US009206678B2

(12) United States Patent
Rytlewski

(10) Patent No.: US 9,206,678 B2
(45) Date of Patent: Dec. 8, 2015

(54) ZONAL CONTACT WITH CEMENTING AND FRACTURE TREATMENT IN ONE TRIP

(75) Inventor: Gary L. Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1010 days.

(21) Appl. No.: 13/250,519

(22) Filed: Sep. 30, 2011

(65) Prior Publication Data

US 2012/0080190 A1 Apr. 5, 2012

Related U.S. Application Data

(60) Provisional application No. 61/389,070, filed on Oct. 1, 2010.

(51) Int. Cl.

| | |
|---|---|
| ***E21B 43/26*** | (2006.01) |
| ***E21B 34/14*** | (2006.01) |
| *E21B 34/00* | (2006.01) |

(52) U.S. Cl.

CPC ..... *E21B 43/26* (2013.01); *E21B 34/14* (2013.01); *E21B 43/261* (2013.01); *E21B 2034/005* (2013.01)

(58) Field of Classification Search

USPC ..... 175/64

See application file for complete search history.

(56) References Cited

U.S. PATENT DOCUMENTS

| | | | | |
|---|---|---|---|---|
| 3,289,762 | A * | 12/1966 | Schell et al. | 166/281 |
| 4,673,039 | A | 6/1987 | Mohaupt | |
| 5,425,424 | A * | 6/1995 | Reinhardt et al. | 166/291 |
| 7,387,165 | B2 | 6/2008 | Lopez de Cardenas et al. | E21B 34/14 |
| 7,422,060 | B2 | 9/2008 | Hammami et al. | |
| 7,591,312 | B2 | 9/2009 | Johnson et al. | |
| 8,272,443 | B2 * | 9/2012 | Watson et al. | 166/318 |
| 2006/0196667 | A1 | 9/2006 | Alba et al. | |
| 2007/0272411 | A1 | 11/2007 | Lopez de Cardenas et al. | E21B 43/17 |
| 2008/0142218 | A1 | 6/2008 | Rytlewski et al. | |
| 2008/0210429 | A1 * | 9/2008 | McMillin et al. | 166/313 |
| 2009/0078427 | A1 | 3/2009 | Patel | |
| 2009/0084553 | A1 | 4/2009 | Rytlewski et al. | E21B 43/14 |
| 2009/0223670 | A1 * | 9/2009 | Snider | 166/308.1 |
| 2010/0012318 | A1 | 1/2010 | Luce et al. | |
| 2011/0056692 | A1 | 3/2011 | Lopez de Cardenas et al. | E21B 43/16 |

OTHER PUBLICATIONS

International Search Report and Written Opinion of PCT Application No. PCT/US2011/054503 dated Apr. 10, 2012.

* cited by examiner

*Primary Examiner* — Jennifer H Gay
*Assistant Examiner* — Caroline Butcher
(74) *Attorney, Agent, or Firm* — Patrick Traister

(57) ABSTRACT

Systems and methods for fracturing multiple zones in a wellbore are provided. Cement can be pumped through a work string into a first annulus formed between a liner and a wall of the wellbore. One or more first contact valves in the liner can be opened with the work string. Fluid can flow through the work string and the one or more first contact valves to fracture a first zone. One or more second contact valves in the liner can be opened with the work string. Fluid can flow through the work string and the one or more second contact valves to fracture a second zone.

20 Claims, 8 Drawing Sheets

ZONAL CONTACT WITH CEMENTING AND FRACTURE TREATMENT IN ONE TRIP

CROSS-REFERENCE TO RELATED APPLICATIONS

This application claims the benefit of and priority to U.S. provisional patent application having Ser. No. 61/389,070 that was filed on Oct. 1, 2010, the entirety of which is incorporated by reference herein.

BACKGROUND

Wellbores are drilled through subsurface formations to extract useful fluids, such as hydrocarbons, from one or more producing zones. Once drilled, a liner can be run-in-hole (RIH), and cement can be pumped into the annulus formed between the liner and the wellbore wall. Once the cement sets, one or more perforating guns can be lowered through the liner on a slickline, wireline, or work string proximate a first zone in the formation. The perforating guns can be fired to create radial openings in the liner, thereby forming a path of fluid communication between an inner bore in the liner and the first zone in the formation. Once the openings are created, the perforating guns can pulled back to the surface, and hydraulic fracturing can take place in the first zone.

After the first zone has been fractured, a plug can be lowered down and positioned in the liner above the first zone. One or more perforating guns can also be lowered down and positioned above the plug, proximate a second zone in the formation. As with the first zone, the perforating guns can disconnect and fire to create radial openings in the liner to form a path of fluid communication between the inner bore in the liner and the second zone. The perforating guns can then be pulled back to the surface, and hydraulic fracturing can take place in the second zone. This process can be repeated for multiple zones within the wellbore.

To treat thick producing zones, long guns are used, and their weight requires the guns to be lowered in the wellbore via a work string. The use of a work string to conduct any well intervention takes more time than with a wireline and becomes very costly in deep wells in deep water. The raising and lowering of the work string and associated components, can contribute to the fracturing process taking between ten and fifteen days per zone. As such, a wellbore having multiple zones can take weeks or even months before production begins. What is needed, therefore, is an improved system and method for fracturing multiple zones in a wellbore.

SUMMARY

Systems and methods for fracturing multiple zones in a wellbore are provided. In one aspect, the method is performed by pumping cement through a work string into a first annulus formed between a liner and a wall of the wellbore. One or more first contact valves in the liner can be opened with the work string, and the one or more first contact valves can be disposed proximate a first zone of the wellbore. A fluid can flow through the work string and the one or more first contact valves to fracture the first zone. One or more second contact valves in the liner can be opened with the work string. The one or more second contact valves can disposed proximate a second zone of the wellbore, above the one or more first contact valves, and opened after the first zone is fractured. Fluid can flow through the work string and the one or more second contact valves to fracture the second zone.

In one aspect, the system can include a liner disposed within the wellbore. One or more first contact valves can be disposed in the liner proximate a first zone of the wellbore. A flapper valve can be disposed in the liner and positioned above the one or more first contact valves. One or more second contact valves can be disposed in the liner proximate a second zone of the wellbore, and the one or more second contact valves can be positioned above the flapper valve. A work string can be movable within the liner and adapted to introduce cement into a first annulus between the liner and a wall of the wellbore, to open the one or more first contact valves, and to introduce a fluid into the liner to fracture the first zone.

BRIEF DESCRIPTION OF THE DRAWINGS

So that the recited features can be understood in detail, a more particular description, briefly summarized above, can be had by reference to one or more embodiments, some of which are illustrated in the appended drawings. It is to be noted, however, that the appended drawings illustrate only typical embodiments and are therefore not to be considered limiting of its scope, for the invention can admit to other equally effective embodiments.

DETAILED DESCRIPTION

Figure 1:
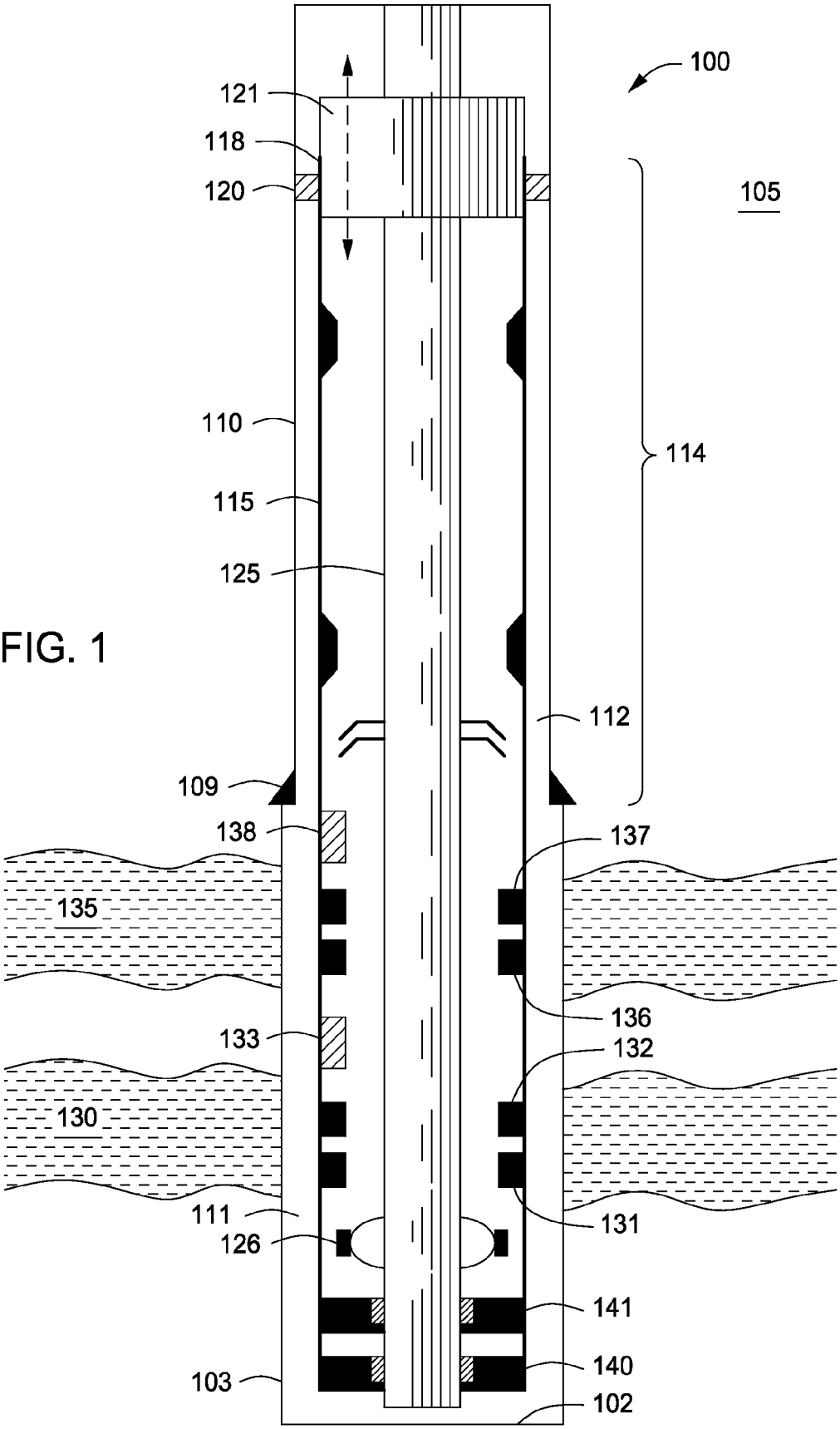
FIG. 1 depicts a cross-sectional view of a wellbore in a subsurface formation, according to one or more embodiments described.

FIG. 1 depicts a cross-sectional view of a wellbore 100 in a subsurface formation 105, according to one or more embodiments. A casing 110 can be disposed within the wellbore 100. The casing 110 can extend from the surface down to the bottom or toe 102 of the wellbore 100, or to a point above one or more stages or zones 130, 135 that are to be fractured, as described below. The casing 110 can have an inner diameter of between about 9 inches and about 12 inches.

A liner 115 can also be disposed within the wellbore 100. The liner 115 can extend from a liner top 118, which can be anchored to a liner hanger 120, through the one or more zones 130, 135, and to the toe 102 of the wellbore 100. A liner top running tool 121 can be used to set the liner hanger 120 and associated seals. A first annulus 111 can be formed between the liner 115 and a wall 103 of the wellbore 100. A portion of the liner 115 can be disposed within a portion of the casing 110, creating an overlap region 114 extending a distance of between about 200 feet and about 1000 feet. For example, the length of the overlap can be roughly the length of the open hole, i.e., the distance from the bottom 109 of the casing 110 to the toe 102 of the wellbore 100. A second annulus 112 can be formed in the overlap region 114 between the liner 115 and the casing 110. The second annulus 112 can be in fluid communication with the first annulus 111. Additionally, the liner 115 can have an inner diameter of between about 8 inches and about 10 inches.

The liner 115 can include one or more zonal contact valves 131, 132, 136, 137 disposed within and/or aligned with each zone 130, 135. The contact valves 131, 132, 136, 137 can be each be disposed proximate one or more radial ports (not shown) through the liner 115. The contact valves 131, 132, 136, 137 can be actuated between an open position in which the corresponding port is unobstructed, and a closed position in which the corresponding port is obstructed. As shown, contact valves 131, 132 are disposed within a first, lower zone 130, and contact valves 136, 137 are disposed within a second, upper zone 135. However, as will be appreciated, the number of zones 130, 135 and the number of valves 131, 132, 136, 137 disposed therein can vary depending on the length of the wellbore 100, the volumetric flow rate into the liner 115, etc. For example, each zone 130, 135 can be between about 200 feet long and about 1000 feet long, and each zone 130, 135 can include between about 1 and about 15 contact valves 131, 132, 136, 137. For example, one or more of the contact valves 131, 132, 136, 137 can have a 6.25 inch inner diameter and a 10.5 inch outer diameter.

The liner 115 can also include one or more one-way valves 133, 138, such as flapper valves, disposed between the zones 130, 135. For example, the flapper valves 133, 138 can be large bore flapper valves positioned above the contact valves 131, 132, 136, 137 in each zone 130, 135. The flapper valves 133, 138 can be actuated between an open position allowing bi-directional fluid flow through the liner 115, and a closed position allowing uni-directional, i.e., upward, fluid flow through the liner 115. As used herein, "upward" includes a direction toward the head of the wellbore 100, i.e., away from the toe 102. For example, one or more of the flapper valves 133, 138 can have about a 6.25 inch inner diameter and about a 10.5 inch outer diameter.

A work string 125 can be disposed within the casing 110 and/or liner 115. The work string 125 can include one or more valve shifting tools 126, such as collets, coupled to an end thereof. The valve shifting tool 126 can be adapted to engage and open the contact valves 131, 132, 136, 137 with an upward motion. Alternatively, the valve shifting tool 126 can be adapted to engage and open the contact valves 131, 132, 136, 137 with a downward motion. For example, the valve shifting tool 126 can be run downhole in a collapsed or non-engaging position and activated when the work string 125 and/or the valve shifting tool 126 contacts the toe 102 of the wellbore 100 or when a pressure operated sleeve is retracted. The work string 125 can then be pulled up above the contact valves (for example 131, 132) and moved downward again to open the contact valves 131, 132. The contact valves 131, 132 can lock open such that the work string 125 can then be pulled upward without closing the valves 131, 132. Although the work string 125 is depicted with a collet 126 adapted to actuate, i.e., open and close, the contact valves 131, 132, 136, 137, it can be appreciated that the work string 125 can include any device known in the art capable of actuating the contact valves 131, 132, 136, 137 such as, for example, spring-loaded keys, drag blocks, snap-ring constrained profiles, and the like.

A float collar 140 can be disposed at the bottom of the liner 115, proximate the toe 102 of the wellbore 100. The work string 125 can be adapted to stab into and seal with the float collar 140, as shown in FIG. 1. An exemplary float collar 140 can have an inner diameter ranging from about 6.25 inches to about 8.5 inches and an outer diameter of about 9.87 inches.

In at least one embodiment, a formation isolation valve ("FIV") 141 can also be disposed at the bottom of the liner 115, either above or below the float collar 140. In another embodiment, the FIV 141 can replace the float collar 140. The FIV 141 can be a ball valve, a check valve, or a combination thereof. When closed, the FIV 141 can provide a "hard bottom" mechanical seal preventing fluids from flowing therethrough (in at least one direction) and creating high pressure integrity within the liner 115.

Figure 2:
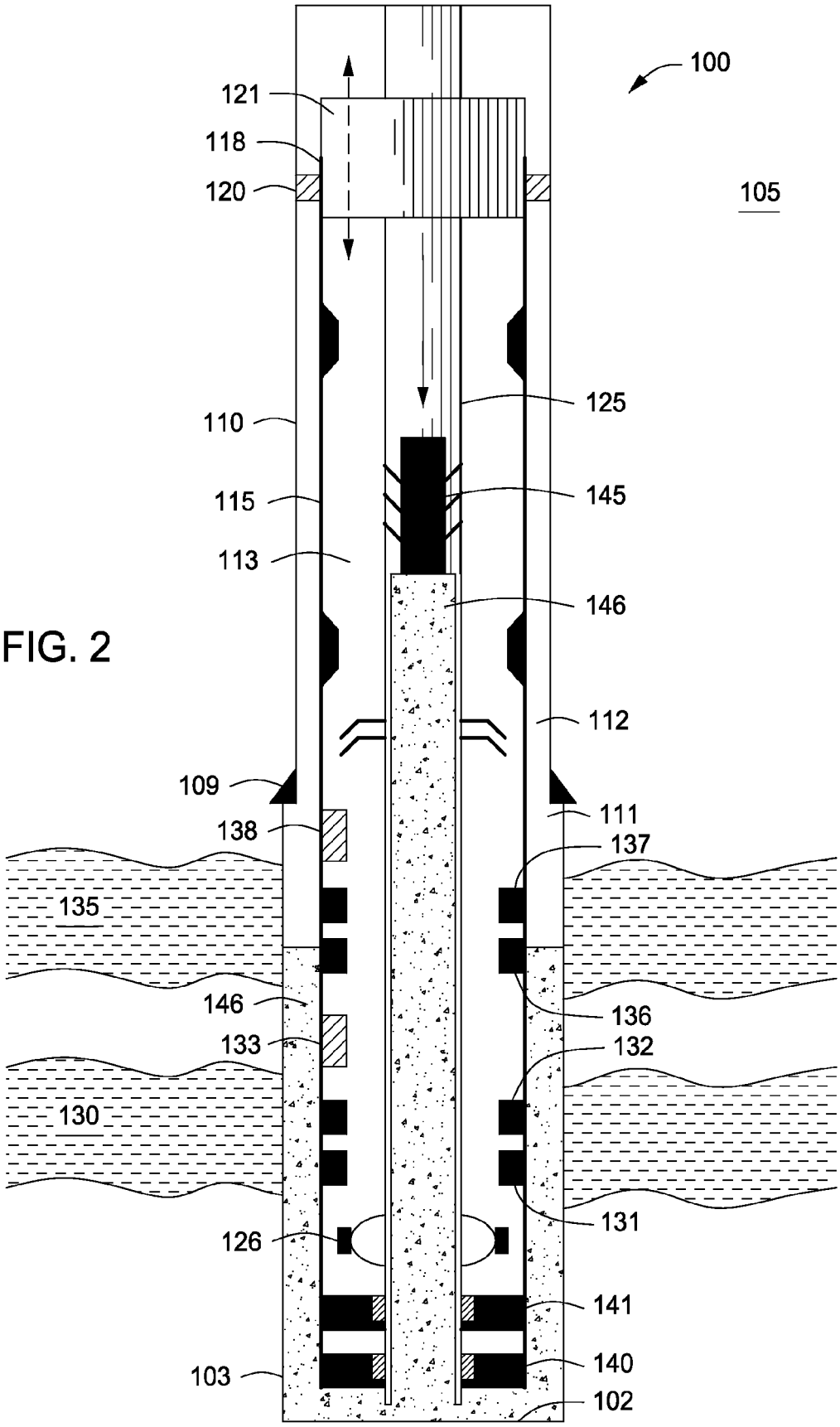
FIGS. 2 and 3 depict a liner being cemented into the wellbore of FIG. 1, according to one or more embodiments described.
Figure 3:
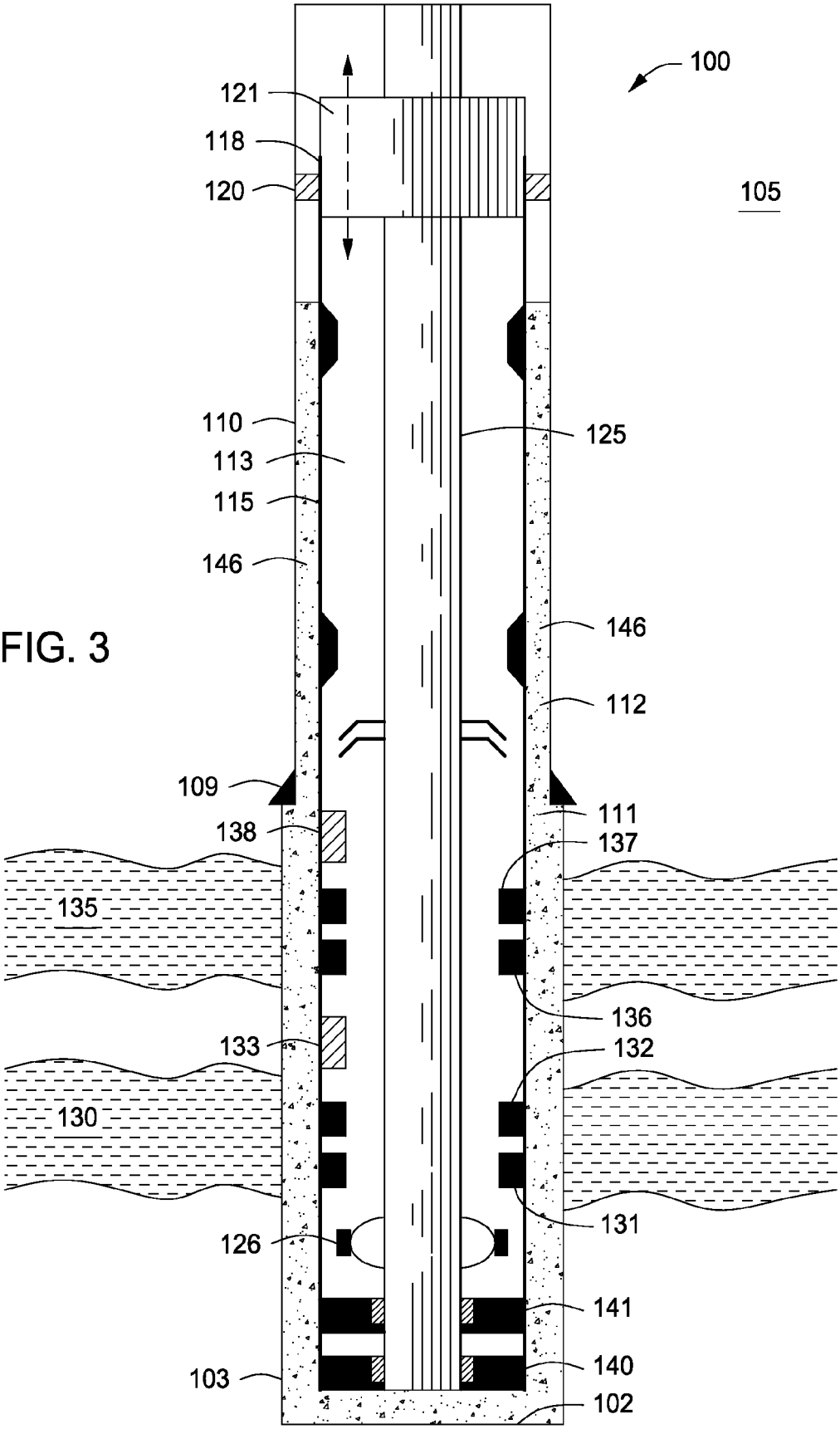

In operation, the work string 125 can be lowered into the wellbore 100, and an end of the work string 125 can stab into and seal with the float collar 140 and/or FIV 141 proximate the toe 102 of the wellbore 100. Once a seal is formed, the liner 115 can be cemented into place. FIGS. 2 and 3 depict the liner 115 being cemented into the wellbore 100 of FIG. 1, according to one or more embodiments. A cement wiper dart or wiper plug 145 can push cement 146 downward through the work string 125, forcing the cement 146 to exit through the bottom of the work string 125 and flow upward into the first annulus 111 formed between the work string 125 and the wall 103 of the wellbore 100. The wellbore 100 can be under-reamed to create a larger annulus 111 and reduce the pressure generated by the cement 146, thereby reducing the risk of inadvertently fracturing the formation. The larger annulus 111 can also create a stronger cement 146 seal within the annulus 111. The seal between the work string 125 and float collar 140 and/or FIV 141 can prevent the cement 146 from flowing into a third annulus 113 between the work string 125 and the liner 110.

Figure 4:
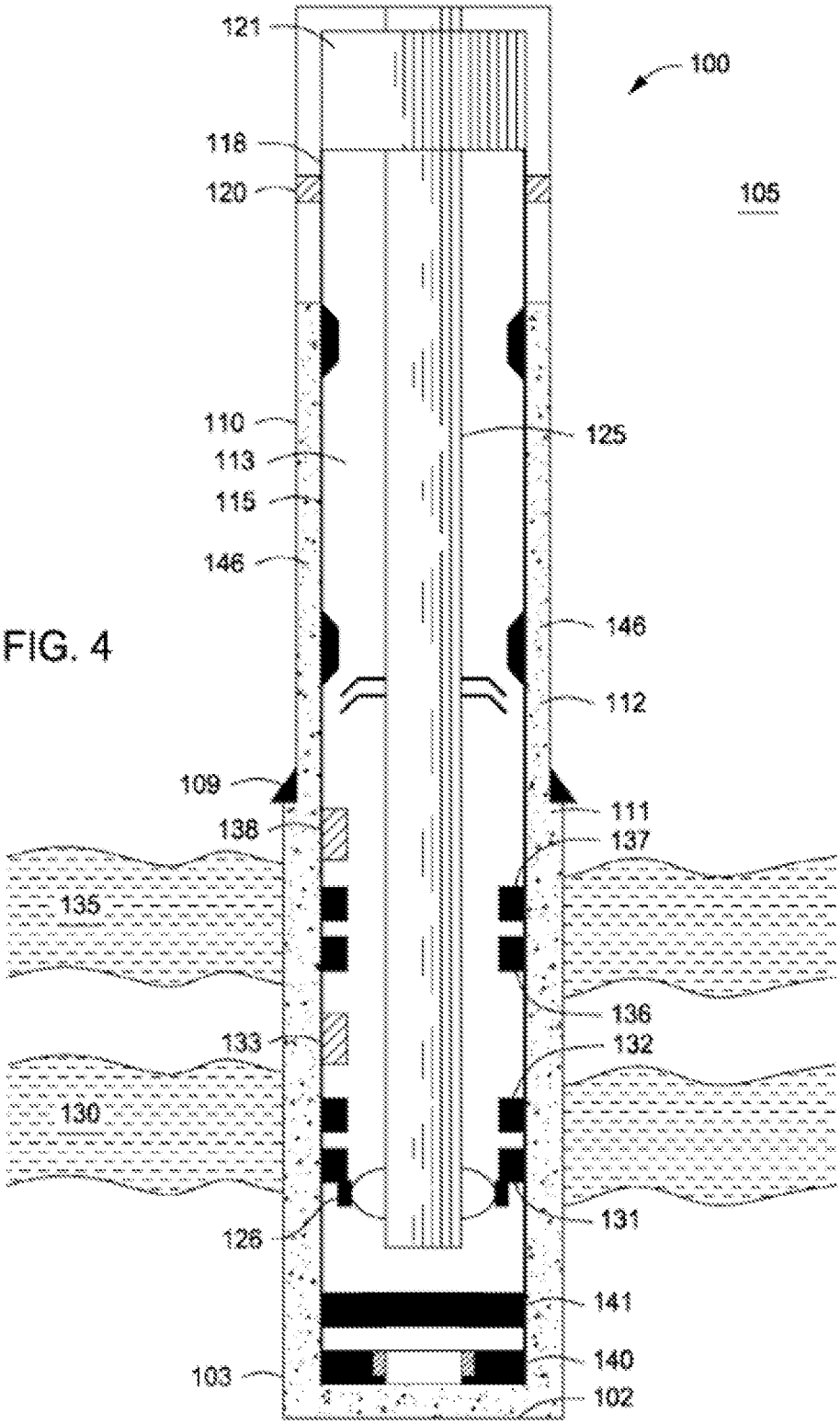
FIG. 4 depicts the liner being pressure tested within the wellbore of FIG. 1, according to one or more embodiments described.

The cement 146 can be pumped up the first annulus 111, above the zones 130, 135, and into the second annulus 112. The cement 146 can provide a seal at the base of the liner 115 to allow the liner 115 to be pressure tested without running a liner top packer downhole. Further, the cement 146 in the overlap region 114 can seal off fracture treatment pressure, for example, if seals on the work string 125 are not used or fail. Once the cement 146 is in place, the work string 125 can remain sealed with the float collar 140, or the work string 125 can be raised slightly to remove the work string 125 from the float collar 140, as shown in FIG. 4. The cement 146 can then cure for between about 4 hours and about 24 hours.

Once the cement 146 has cured, liner 115 can be pressure tested. The areas of the liner 115 to be pressure tested can include the cement 146 seal at the base of the liner 115, the FIV 141 seal, the cement 146 seal in the annulus 112, and/or a seal proximate the liner hanger 120. To pressure test the cement 146 seal at the base of the liner 115, the work string 125 can remain sealed with the float collar 140, and pressure can be applied through the work string 125 to the cement 146 at the base of the liner 115. To pressure test the FIV 141, the work string 125 can be pulled out of the float collar 140 and above the FIV 141, and pressure can be applied through the work string and into the annulus 113 between the work string 125 and the liner 115. In at least one embodiment, the FIV 141 seal can be tested before the cement 146 has cured. To pressure test the cement 146 seal in the annulus 112 and/or the seal proximate the liner hanger 120, pressure can be applied to the annulus 113 between the work string 125 and the liner 115. This pressure can be applied through the work string 125 or through another tubing.

If the liner 115 fails the pressure test, the valve shifting tool 126 can be deactivated, e.g., collapsed, for example, by dropping a ball, and the work string 125 can be pulled out of the wellbore 100 without actuating the contact valves 131, 132, 136, 137. A liner top packer (not shown) can then be inserted to obtain a positive pressure test.

Figure 5:
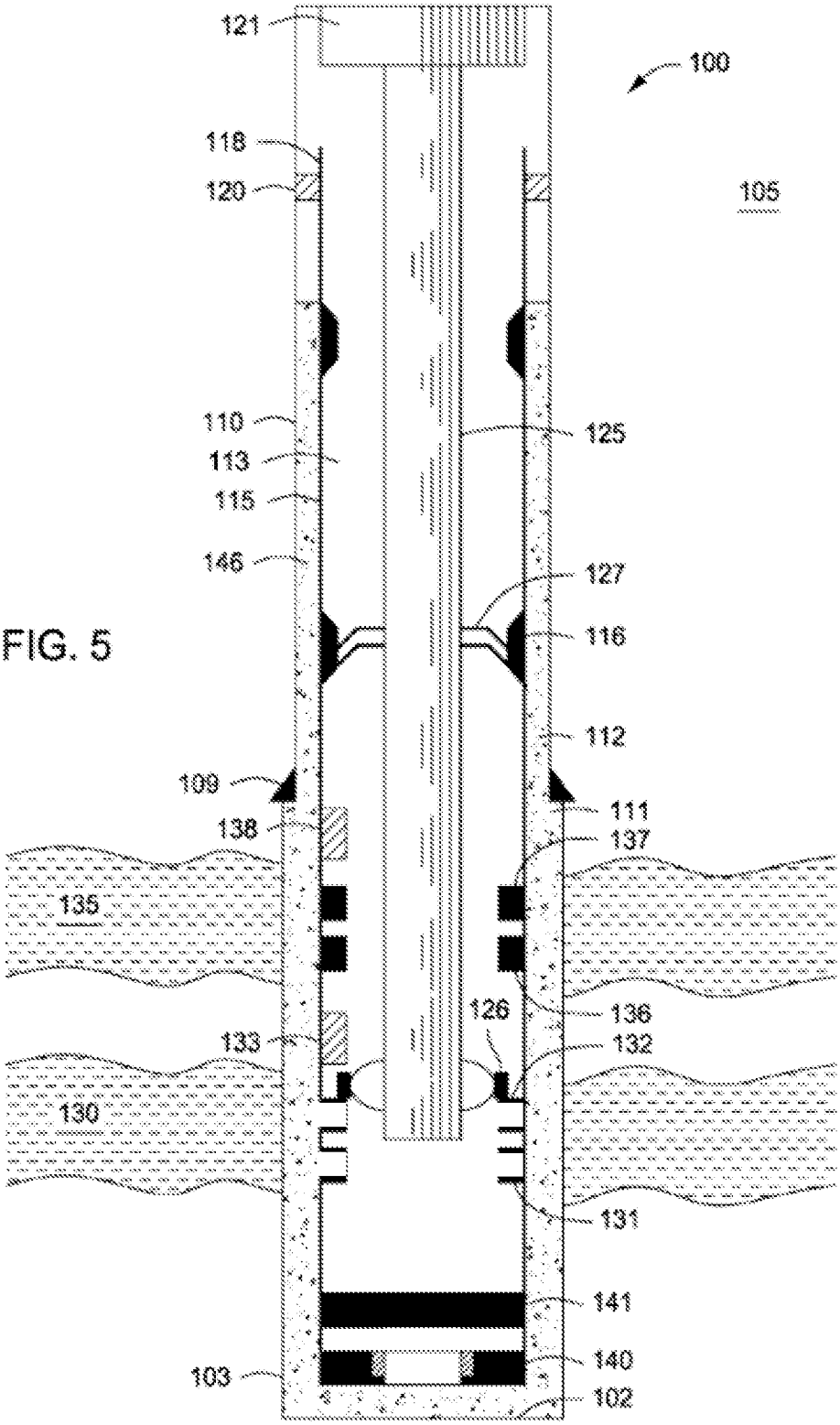
FIGS. 5 and 6 depict the fracturing of a first, lower zone of the wellbore of FIG. 1, according to one or more embodiments described.
Figure 6:
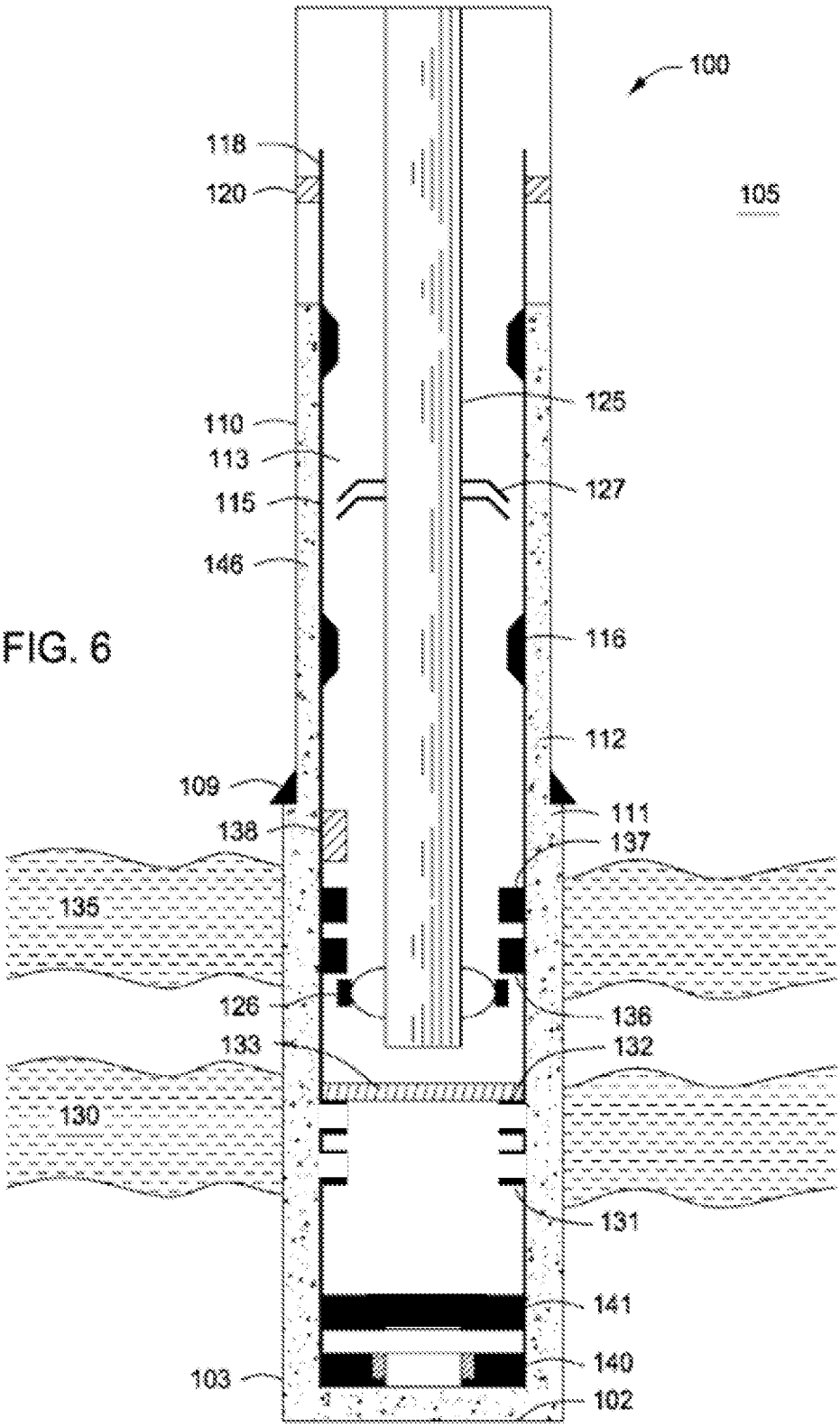

Once the liner 115 has passed the pressure test, the work string 125 can begin actuating the contact valves 131, 132, 136, 137. FIGS. 5 and 6 depict the fracturing of the first, lower zone 130 of the wellbore 100 of FIG. 1, according to one or more embodiments. As used herein, "lower" includes any location in the wellbore 100 that is closer to the toe 102 than another location. The work string 125 can be pulled upward, and the valve shifting tool 126 can engage and open the contact valves 131, 132 in the first zone 130. Once opened, proppant-laden fluid can flow through the work string 125 and the contact valves 131, 132, thereby fracturing the first zone 130. One or more work string seals 127 can engage and form a seal with one or more first liner seals 116 to isolate the liner top 118 from fracture treating net pressures. The liner seals 116 can be swab cup seals. In at least one embodiment, one or more re-settable packers can be used to isolate the liner top 118 from the fracture treating net pressures. In another embodiment, when the liner hanger 120, liner 115, and casing 110 are designed to hold the fracture treating net pressures, no seals may be used. The weight of the work string 125 can help to counteract the upward force generated by the pressure of the fracture treatment.

Once the first zone 130 has been fractured, the work string 125 can be pulled upward such that the valve shifting tool 126 engages the flapper valve 133 and moves it into the closed position, as illustrated in FIG. 6. In at least one embodiment, a low pressure test can be conducted when the flapper valve 133 actuates into the closed position. When in the closed position, fluid such as a hydrocarbon or other type of stream, can flow upward through the flapper valve 133; however, no fluid can flow downward through the flapper valve 133. As such, fracturing can take place in the second zone 135, above the first zone 130, while leaving the contact valves 131, 132 in the first zone 130 in the open position. As used herein, "above" includes any location in the wellbore 100 that is closer to the head, i.e., farther from the toe 102, than another location.

Figure 7:
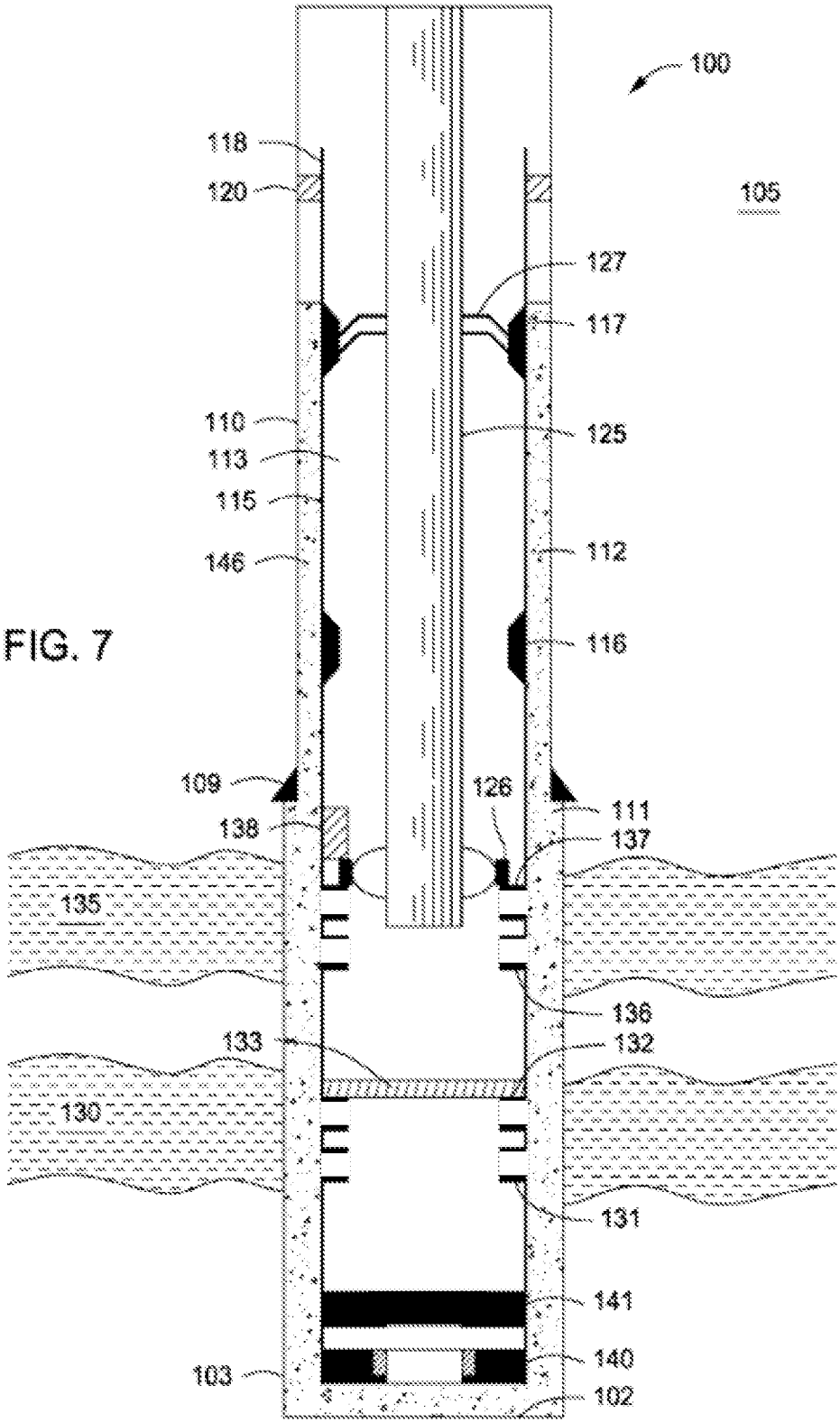
FIGS. 7 and 8 depict the fracturing of a second, upper zone of the wellbore of FIG. 1, according to one or more embodiments described.
Figure 8:
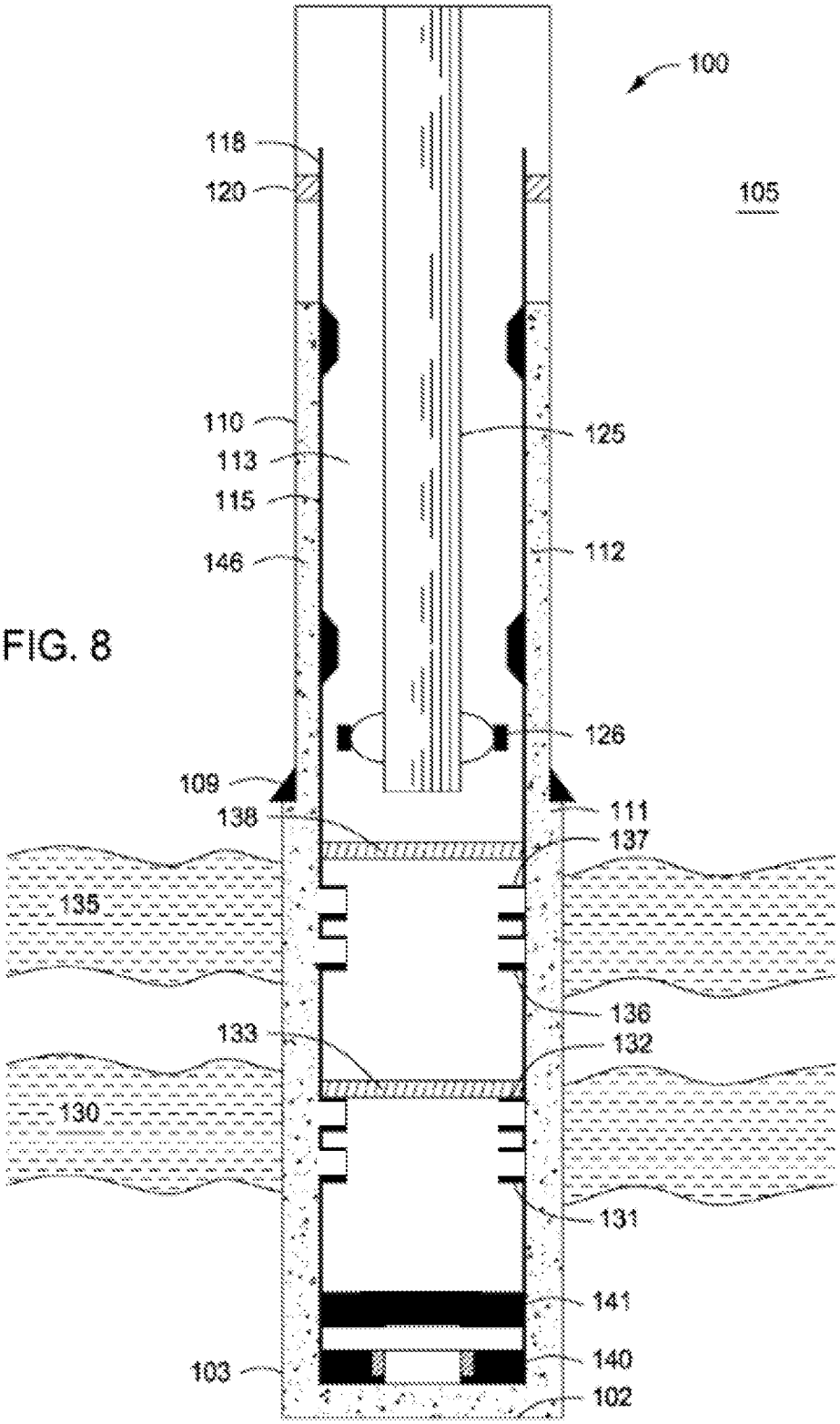

FIGS. 7 and 8 depict the fracturing of the second zone 135 of the wellbore 100 of FIG. 1, according to one or more embodiments. The work string 125 can be pulled upward, and the valve shifting tool 126 can engage and open the contact valves 136, 137 in the second zone 135. Once opened, the proppant-laden fluid can flow through the work string 125 and the contact valves 136, 137 and fracture the second zone 135. The work string seal 126 can engage and form a seal with one or more second liner seals 117 to isolate the liner top 118 from fracture treating net pressures. The flapper valve 133 can isolate the first zone 130 from the second zone 135 such that the fracture treating net pressures do not affect, or minimally affect, the first zone 130 and the open contact valves 131, 132 therein. In another embodiment, the contact valves 131, 132 in the first zone 130 can be closed during the fracturing of the second zone 135.

Once the second zone 135 has been fractured, the work string 125 can be pulled upward allowing the flapper valve 138 to move into the closed position. As such, fracturing can take place in subsequent zones above the second zone 135 while leaving the contact valves 136, 137 in the second zone 135 in the open position.

When all zones 130, 135 have been fractured, the work string 125 can be tripped out of the wellbore 100, and a wash-out milling tool can be used to mill out the flapper valves 133, 138 and/or clean out the wellbore 100. In another embodiment, the work string 125 can be moved down break out the flapper valves 133, 138 while circulating or reverse circulating to clean out sand in the wellbore 100. Thus, during a single trip for the work string 125 in the wellbore 100, the work string 125 can cement the liner 115 in place, the liner 115 can be pressure tested, and multiple zones 130, 135 can be fractured. In at least one embodiment, the liner 115 can be installed, cemented in place, and pressure tested, multiple zones 130, 135 can be fractured one at a time, and the zones 130, 135 can be cleaned out with sand, all in a single trip with the work string 125. As such, multiple zones 130, 135 in the wellbore 100 can be fractured and prepared to produce in a shorter period of time than can be achieved using conventional techniques where the work string is raised and lowered multiple times.

Once the work string 125 has been pulled out of the wellbore 100, a lower completion can be run into the wellbore 100. The lower completion can be adapted to run in screens, blast joints, and packers, e.g., swellable packers, inflatable packers, mechanical packers, or the like. The lower completion can have a blast joint proximate one or more of the contact valves 131, 132, 136, 137. The packer can be positioned above one of the contact valves 131, 132, 136, 137, and the screen can be positioned below the blast joint. As such, if sand or formation is produced, the blast joint can survive the erosion velocity and send the fluid downward toward the screens. Thus, if one zone 130, 135 is sanded in, the packers can isolate this zone 130, 135 such that other zones are not affected.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A method for fracturing multiple zones in a wellbore, comprising:

running a work string into a liner that is positioned in the wellbore, wherein a first annulus is formed between the liner and a wall of the wellbore;

pumping cement through the work string into the first annulus;

opening one or more first contact valves in the liner with the work string, wherein the one or more first contact valves are disposed proximate a first zone of the wellbore;

flowing a fluid through the work string and the one or more first contact valves to fracture the first zone;

opening one or more second contact valves in the liner with the work string, wherein the one or more second contact valves are disposed proximate a second zone of the wellbore; and flowing the fluid through the work string and the one or more second contact valves to fracture the second zone, wherein, in a single trip of the work string in the wellbore:

the cement is pumped into the first annulus, the first zone is fractured, and the second zone is fractured.

2. The method of claim 1, wherein running the work string into the liner comprises stabbing the work string into a float collar proximate an end of the liner such that the work string seals with the float collar.

3. The method of claim 1, wherein the first annulus is in fluid communication with a second annulus formed between the liner and a casing disposed radially-outward therefrom.

4. The method of claim 3, further comprising pumping the cement into the second annulus.

5. The method of claim 1, further comprising pressure testing the liner after the cement has cured and before the first and second zones are fractured.

6. The method of claim 1, wherein opening the one or more first contact valves further comprises pulling the work string upward such that a valve shifting tool coupled thereto engages and opens the one or more first contact valves.

7. The method of claim 1, further comprising isolating a top of the liner from the first zone when the first zone is being fractured.

8. The method of claim 7, wherein isolating the top of the liner further comprises moving the work string axially with respect to the liner to engage one or more seals coupled to the liner with one or more seals coupled to the work string.

9. The method of claim 1, further comprising isolating the first zone from the second zone when the second zone is being fractured.

10. The method of claim 9, wherein isolating the first zone further comprises moving the work string axially with respect to the liner to close a flapper valve positioned in the liner between the first and second zones, wherein the first contact valves remain open after the flapper valve is closed.

11. The method of claim 1, wherein the wellbore is under-reamed.

12. A method for fracturing multiple zones in a wellbore, comprising:

running a work string into a liner that is positioned in the wellbore, wherein a first annulus is formed between the liner and a wall of the wellbore;

pumping cement through the work string into the first annulus;

pumping the cement into a second annulus formed between the liner and a casing disposed radially-outward therefrom, wherein the first annulus is in fluid communication with the second annulus;

pressure testing the liner after the cement has cured;

opening one or more first contact valves in the liner with the work string, wherein the one or more first contact valves are disposed proximate a first zone of the wellbore;

flowing a fluid through the work string and the one or more first contact valves to fracture the first zone;

closing a flapper valve in the liner with the work string, wherein the flapper valve is positioned above the first zone;

opening one or more second contact valves in the liner with the work string, wherein the one or more second contact valves are disposed proximate a second zone of the wellbore, wherein the one or more second contact valves are positioned above the flapper valve, and wherein the one or more second contact valves are opened after the first zone is fractured; and flowing the fluid through the work string and the one or more second contact valves to fracture the second zone;

wherein, in a single trip of the work string in the wellbore:

the cement is pumped into the first and second annuli, the first zone is fractured, and the second zone is fractured.

13. The method of claim 12, wherein running the work string into the liner comprises stabbing the work string through a formation isolation valve disposed in the liner and proximate an end of the liner; and further comprising:

pumping the cement into the first annulus through the formation isolation valve; and closing the formation isolation valve with the work string when the work string is pulled through the formation isolation valve after pumping the cement.

14. The method of claim 12, wherein closing the flapper valve further comprises pulling the work string upward such that a valve shifting tool coupled thereto engages and closes the flapper valve, wherein the one or more first contact valves remain open after the flapper valve is closed.

15. The method of claim 12, wherein pressure testing the liner further comprises applying pressure to at least one of the first and second annuli.

16. A system for fracturing multiple zones in a wellbore, comprising:

a liner disposed within the wellbore;

one or more first contact valves disposed in the liner proximate a first zone of the wellbore;

a flapper valve disposed in the liner and positioned above the one or more first contact valves;

one or more second contact valves disposed in the liner proximate a second zone of the wellbore, wherein the one or more second contact valves are positioned above the flapper valve; and a work string movable within the liner and adapted to perform the following actions in a single trip of the work string in the wellbore:

stab into and seal with a float collar proximate an end of the liner, introduce cement into a first annulus between the liner and a wall of the wellbore, open the one or more first contact valves, introduce a fluid into the liner to fracture the first zone, open the one or more second contact valves, and introduce the fluid into the liner to fracture the second zone.

17. The system of claim 16, further comprising a casing disposed in the wellbore and above the first annulus, wherein a second annulus is formed between the liner and the casing, and wherein the first annulus is in fluid communication with the second annulus.

18. The system of claim 17, wherein the liner comprises one or more liner seals adapted to sealingly engage with one or more work string seals coupled to the work string in response to the work string being moved with respect to the liner.

19. The system of claim 16, further comprising a formation isolation valve disposed proximate the end of the liner, wherein the formation isolation valve is adapted to prevent fluid from flowing therethrough when in a closed position.

20. The system of claim 19, wherein the formation isolation valve comprises a ball valve, a check valve, or a combination thereof.

* * * * *